US005604521A

United States Patent [19]

Merkel et al.

[11] Patent Number: 5,604,521

[45] Date of Patent: Feb. 18, 1997

[54] SELF-ALIGNING ORIFICE PLATE FOR INK JET PRINTHEADS

[75] Inventors: Harold S. Merkel; David E. Gough, both of Houston, Tex.

[73] Assignee: Compaq Computer Corporation, Houston, Tex.

[21] Appl. No.: 268,816

[22] Filed: Jun. 30, 1994

[51] Int. Cl.[6] ..... B41J 2/14

[52] U.S. Cl. ..... 347/47

[58] Field of Search ..... 347/47

[56] References Cited

U.S. PATENT DOCUMENTS

| | | | |
|---|---|---|---|
| 4,528,575 | 7/1985 | Matsuda et al. | 347/47 |
| 4,611,219 | 9/1986 | Sugitani | 347/47 |
| 5,059,973 | 10/1991 | Watanabe | 347/47 |

*Primary Examiner*—Valerie A. Lund
*Attorney, Agent, or Firm*—Konneker & Smith

[57] ABSTRACT

The present invention is directed to an orifice plate for use with an ink jet printhead assembly and a method for fabricating that orifice plate and a printhead assembly incorporating the orifice plate and a method for fabricating that printhead. The orifice plate has either a projection extending outwardly from a rear side surface of the orifice plate that is configured to be closely received by a corresponding alignment cavity in the front end body portion of the printhead or an alignment cavity formed in the rear side surface of the orifice plate that is configured to closely receive a projection extending outwardly from the front end portion of the printhead body. An ultraviolet light curable adhesive may be used to adhesively intersecure and seal the orifice plate on the printhead body.

11 Claims, 2 Drawing Sheets

SELF-ALIGNING ORIFICE PLATE FOR INK JET PRINTHEADS

BACKGROUND OF THE INVENTION

1. Field of the Invention

The present invention generally relates to printhead assembly apparatus used in ink jet printers, and more particularly relates to the design, manufacture, and assembly of orifice plates for such printhead assemblies.

2. Description of Related Art

A conventionally fabricated printhead assembly for an ink jet printer typically includes a piezoelectric ceramic body portion through which a spaced apart series of parallel ink receiving chambers or cavities extend from the front end of the body to its rear end. The open chamber ends at the rear end of the body are suitably communicated with the interior of an ink reservoir to receive ink therefrom, and an orifice plate, which is comprised of a dissimilar material such as a polymer, is secured over the open front end of the body using a generally planar layer of high strength adhesive material. A spaced series of ink discharge orifice openings are formed through the orifice plate, and are aligned with and positioned over the open front ends of the body chambers.

Because of the small size of these printhead bodies and orifice plates, the plate is applied to the printhead using a manual assembly fixture and aligned under a microscope. This aspect increases the cost and time it takes to manufacture such devices. The orifice plate and the printhead body are typically secured together with an adhesive. The adhesive that is used to secure the orifice plate to the printhead body is "activated" or cured by subjecting the printhead assembly to high temperatures. When bonded, the assembled printhead is removed from the oven, allowed to cool and removed from the assembly fixture. Since the body portion and the orifice plate of these conventional ink jet printhead assemblies are typically constructed from dissimilar materials, they have differing thermal coefficients of thermal expansion. As such, several problems can arise during the fabrication of these conventional printheads.

For example, because of the differing coefficients of thermal expansion between the materials, the ink discharge orifices of the orifice plate can become misaligned with the ink receiving chamber in the printhead body portion when the printhead assembly is subjected to the high temperatures necessary to cure the adhesive properly. Since the orifice array and its features are extremely small, with the orifice holes being generally in the range of 0.0001 to 0.002 inches in diameter, the dimensional tolerances on the size and location of these features are equally small—along the order of 0.00004 of an inch. Therefore, any misalignment that may occur during the curing process can have a detrimental effect on the quality and the performance of the ink jet printhead.

Additionally, the conventional adhesives, or other materials that may be used to attach the orifice plate to the body portion, must also act as a sealing gasket to seal the printhead assembly and prevent ink from leaking between the channels or various segregated areas of the printhead. Unfortunately, however, the strong solvent nature of most inks chemically attacks many common adhesives, thereby weakening the adhesive and causing structural failure and leakage. Furthermore, after the adhesive is applied to the body portion and the orifice plate is put in place, the adhesive may seep into and plug the ink receiving chambers and the orifice holes during the assembly process.

Therefore, it can readily be seen that there is a need in the art for an orifice plate and method of manufacture thereof that will provide an orifice plate that can be easily and properly aligned with the body portion and one that will prevent the adhesive from plugging the ink receiving chambers and the ink discharge orifices. The present invention provides an apparatus and method that addresses these needs.

SUMMARY OF THE INVENTION

In carrying out principles of the present invention, in accordance with a preferred embodiment thereof, there is provided an orifice plate for use in conjunction with an ink jet printer printhead assembly having a body portion and at least one cavity opening outwardly through a front end surface of the body portion. The orifice plate is a plate-like member having ink discharge orifices formed therethrough, a front side surface and a rear side surface. The rear side surface has at least one projection extending outwardly therefrom configured to be closely received by a front end portion of at least one of the cavities to align the ink discharge orifices with the cavities. Preferably, the projection is formed from the rear side of the orifice plate by a laser ablation process, and the ink discharge orifices are formed through the projection to the front side surface of the orifice plate.

In another aspect of the embodiment just described, the projection is mesa-like with outer side edge portions that are tapered inwardly toward the center of the projection. The projection is configured to be closely received by a front end portion of the ink receiving cavity in the printhead assembly. The cooperation of the projection on the orifice plate with the front end portion of the ink receiving cavity serves to align the plate-like member with the front end surface of the body portion and thereby align the ink discharge orifices with the ink receiving cavities in the body portion.

In another aspect of the present invention, the projections are formed from the front end surface of the printhead by a laser ablation process, and the corresponding cavities are integrally formed in the rear side surface of the orifice plate.

In yet another aspect of the present invention, a printhead assembly for use in an ink jet printer is provided. The body portion is formed from a piezoelectric ceramic material and has a front end surface and a spaced apart interior series of ink receiving cavities opening outwardly through the front end surface of the body portion. The orifice plate has discharge orifices formed therethrough, a front side surface and a rear side surface disposed in an opposing, closely adjacent relationship with the front end surface of the body portion. At least one alignment cavity is formed in either the front end surface of the body portion or the rear side surface of the orifice plate with at least one corresponding alignment projection extending outwardly from either the front end surface of the body portion or the rear side surface of the orifice plate. The alignment projection is configured to be closely received by the alignment cavity to align the ink discharge orifices with the interior ink receiving cavities of the body portion. The configuration of the alignment projection also prevents the adhesive from flowing into the ink receiving cavity.

In another aspect of the embodiment just described, the alignment projection, which is preferably a mesa-like projection, is formed and extends outwardly from the rear side surface of the orifice plate, and the alignment cavity is formed in the front end surface of the body portion. The alignment cavity or cavities may be formed at the outer corners of the front end surface of the body portion. Preferably, however, the alignment cavities are the ink receiving cavities of the body portion, and the projections, with ink discharge orifices formed therethrough, are formed on the rear side surface of the orifice plate to align with the ink receiving cavities.

Alternatively, the alignment projection may extend outwardly from one of the front end surface corners of the body portion with the corresponding alignment cavity being formed at one of the corners within the rear side surface of the orifice plate. Preferably, both the projection and the cavity are formed by using a laser ablation process.

In another aspect of the present invention just described, the printhead assembly further comprises an adhesive material sandwiched between the orifice plate and the body portion that adhesively secures the rear side surface of the orifice plate and the front end surface of the body portion. The adhesive is preferably an ultra-violet light curable adhesive that hardens with exposure to ultra-violet light. In such instances, the orifice plate must allow the ultraviolet light to pass therethrough to allow the adhesive to cure properly.

The present invention also provides a method of fabricating an orifice plate for use in conjunction with an ink jet printer printhead assembly. The printhead assembly has a body portion and at least one cavity opening outwardly through a front end surface of the body portion. The method comprises the steps of providing a plate-like member having a front side surface and a rear side surface. At least one projection extending outwardly from the rear side surface is formed from the rear side surface. The projection is configured to be closely received by the front end portion of the cavity for aligning the plate-like member with the front end surface of the body portion. Ink discharge orifices are formed through the plate-like member. Preferably, the ink discharge orifices are formed through the projection to the front side surface of the orifice plate by a laser ablation process.

In another aspect of the present method invention, there is provided a method of fabricating a printhead assembly comprising the steps of providing a body portion formed from a piezoelectric ceramic material having a front end surface and a spaced apart interior series of ink receiving cavities opening outwardly through the front end surface. An orifice plate having ink discharge orifices therethrough, a front side surface and a rear side surface disposed in an opposing, closely adjacent relationship with the front end surface of the body portion is also provided. At least one, and preferably more, alignment cavity or cavities are formed in either the front end surface of the body portion or the rear side surface of the orifice plate. At least one corresponding alignment projection extending outwardly from either the front end surface of the body portion or the rear side surface of the orifice plate is also formed. The alignment projection is configured to be closely received by the alignment cavity to align the ink discharge orifices with the interior ink receiving cavities of the body portion. A layer of ultra-violet light curable adhesive material is sandwiched between the front end surface of the body portion and the rear side surface of the orifice plate. Once the plate is positioned on the body portion, the printhead assembly and the adhesive material is subjected to ultra violet light to cure the adhesive material.

The foregoing has outlined rather broadly the features and technical advantages of the present invention so that the detailed description of the invention that follows may be better understood. Additional features and advantages of the invention will be described hereinafter which form the subject of the claims of the invention. Those skilled in the art should appreciate that they can readily use the disclosed conception and specific embodiment as a basis for designing or modifying other structures for carrying out the same purposes of the present invention. Those skilled in the art should also realize that such equivalent constructions do not depart from the spirit and scope of the invention as set forth in the appended claims.

DETAILED DESCRIPTION

Figure 1:
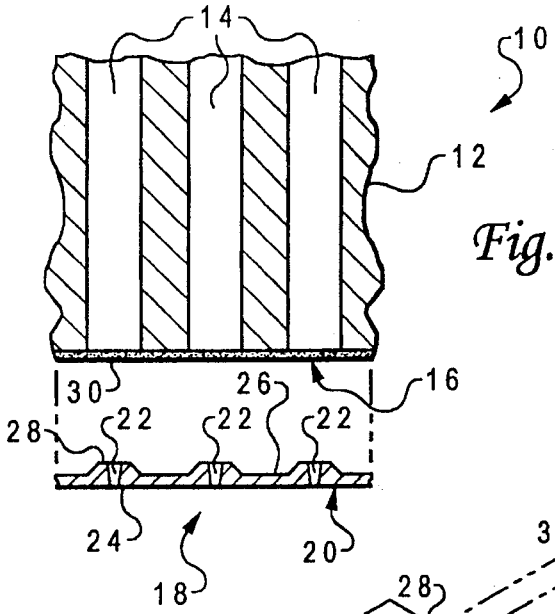
FIG. 1 illustrates an overhead cross-sectional view of a printhead assembly with a body portion having ink receiving cavities therein, an orifice plate having ink discharge orifices extending therethrough and projections extending outwardly from the rear side surface of the orifice plate.

Referring initially to FIG. 1, in a preferred embodiment thereof, there is provided a printhead assembly 10 having a body portion 12 with at least one ink receiving cavity 14 opening outwardly through a front end surface 16 of the body portion 12. The body portion 12 is preferably comprised of a piezoelectric material and more preferably is comprised of a piezoelectric ceramic material. Closely adjacent to the front end surface 16 is an orifice plate 18, which may be comprised of a very thin metallic material or a thermoplastic polymer material, such as a polyimide, polyester or polysulfone. Preferably, the material from which the orifice plate is constructed allows ultra-violet light to pass therethrough. The orifice plate 18 is comprised of a plate-like member 20 having ink discharge orifices 22 formed therethrough, a front side surface 24 and a rear side surface 26 disposed in an opposing, closely adjacent relationship with the front end surface 16 of the body portion 12. The rear side surface 26 has at least one orifice plate projection 28 extending outwardly therefrom that is configured to be closely received by a front end portion of one of the ink receiving cavities 14. The ink discharge orifices 22 are preferably formed through the orifice plate projections 28 to the front side surface 24 of the plate-like member 20. The configuration of the orifice plate projections 28 serves to properly align the ink discharge orifices 22 with the ink receiving cavities 14 when the orifice plate 18 is secured to the body portion 12.

The orifice plate 18 is secured to the body portion 12 by a securing means, such as an adhesive layer 30. While the adhesive layer 30 may be any conventional adhesive used in the fabrication of printhead assemblies, it is preferable that the adhesive layer 30 is an ultra-violet curable adhesive. This aspect allows the printhead assembly 10 to be cured using ultra-violet light instead of being subjected to the stressful high temperatures that are needed for more conventional adhesives. The adhesive layer 30 performs two basic functions. First, it secures the orifice plate 18 to the body portion 12. Second, the adhesive layer 30 acts like a gasket in that it seals the ink receiving cavities 14 from one another to prevent leakage therebetween and to prevent leakage from the printhead assembly 10 in general. Alternatively, the orifice plate projections 28 may be configured to precisely fit the dimensions of the ink receiving cavities to effectively seal the ink receiving cavities 14 when the orifice plate 18 and the body portion 12 are secured together.

Because of the unique configuration of the projections and the alignment function they perform, the manufacture and assembly of orifice plate and the printhead assembly can be performed reliably in a short cycle time with automated manufacturing and assembly equipment, thereby reducing the time and cost of manufacturing the orifice plate and printhead assembly.

Figure 2:
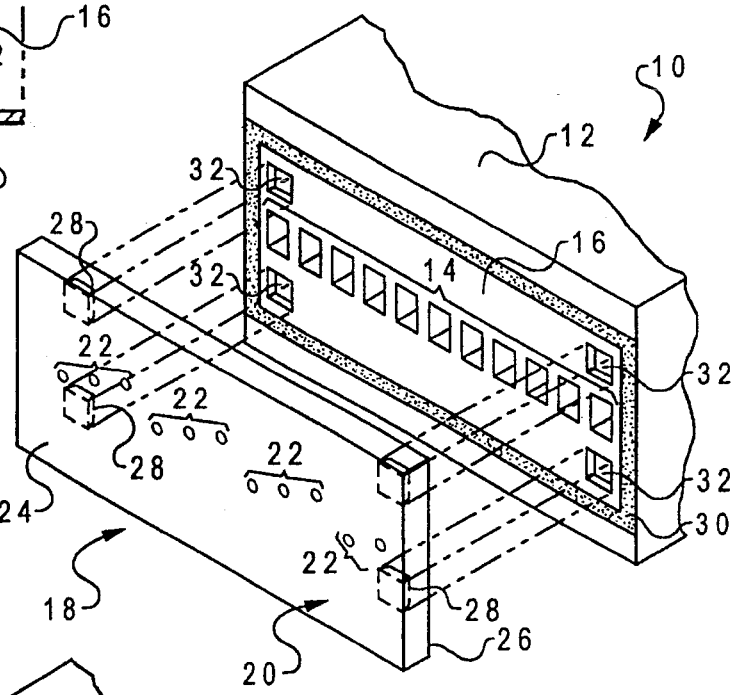
FIG. 2 illustrates a front portion perspective view of a printhead assembly with the projections positioned on the outer corners of the rear side surface of the orifice plate and the alignment cavities positioned on the outer corners of the front end surface of the body portion.

Turning now to FIG. 2, there is illustrated an alternate embodiment of a printhead assembly 10 having a body portion 12 with a front end surface 16 and spaced apart interior ink receiving cavities 14 opening outwardly through the front end surface 16. Also opening outwardly from the front end surface 16 are a plurality of alignment cavities 32 in addition to the ink receiving cavities 14. The orifice plate 18 is comprised of a plate-like member 20 with ink discharge orifices 22 formed therethrough, a front side surface 24 and a rear side surface 26 disposed in an opposing, closely adjacent relationship with the front end surface 16 of the body portion 12. A plurality of orifice plate projections 28 extend outwardly from the rear side surface 26 and are configured to be received by the plurality of alignment cavities 32. In this particular embodiment, the orifice plate projections 28 are preferably formed from the rear side surface 26 at the outer corners of the orifice plate 18 as illustrated in FIG. 2. It should be understood that even though several projections and alignment cavities are illustrated, one projection and corresponding alignment cavity is also within the intended scope of the present invention. The body portion 12 and the orifice plate 18 are preferably sealed and secured together by the adhesive layer 30.

Figure 3:
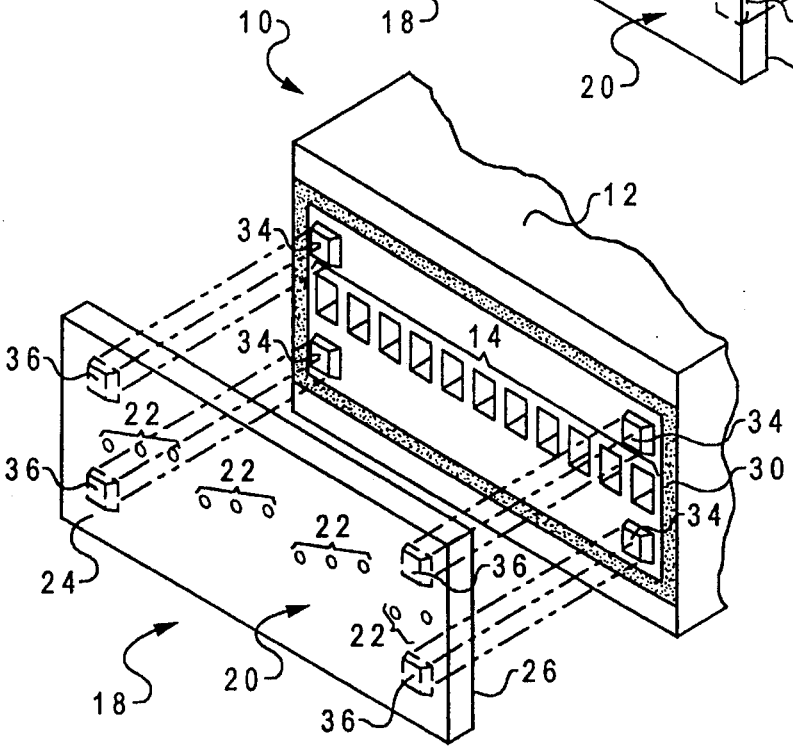
FIG. 3 illustrates a front portion perspective view of a printhead assembly with the projections positioned on the outer corners of the front end surface and the alignment cavities positioned in the outer corners of the rear side surface of the orifice plate.

Turning now to FIG. 3, there is illustrated another alternate embodiment of a printhead assembly 10 having a body portion 12 with a front end surface 16 and spaced apart interior ink receiving cavities 14 opening outwardly through the front end surface 16. Extending outwardly from the front end surface 16 are a plurality of body portion projections 34. Preferably, the body portion projections 34 are formed at the outer corners of the front end surface 16 as illustrated in FIG. 3. The orifice plate 18 is comprised of a plate-like member 20 with ink discharge orifices 22 formed therethrough, a front side surface 24 and a rear side surface 26 disposed in an opposing, closely adjacent relationship with the front end surface 16 of the body portion 12. A plurality of orifice plate alignment cavities 36 are formed in the rear side surface 26 and are configured to receive the plurality of body portion projections 34. Again, it should be understood that it is possible that one projection and corresponding cavity could be sufficient to properly align the orifice plate 18 with the body portion 12.

Figure 4:
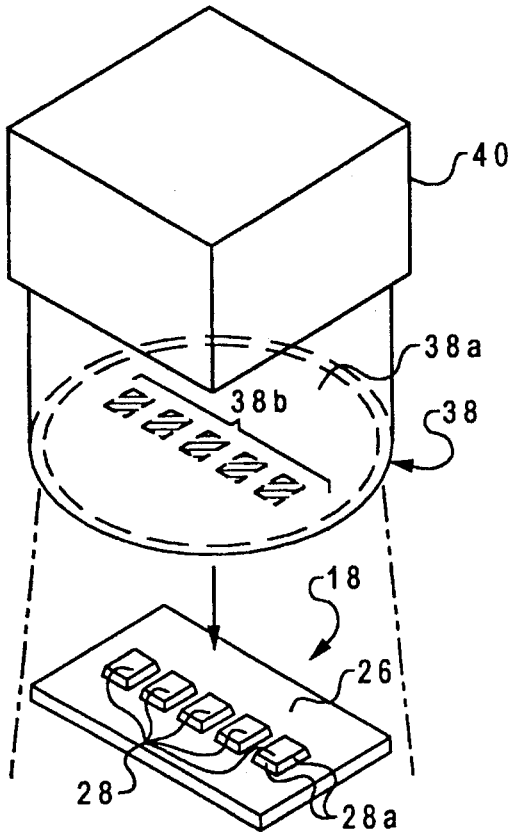
FIG. 4 illustrates an overhead perspective view of an excimer laser with a projection mask positioned thereon and an -orifice plate having mesa-like projections extending outwardly from the rear side surface of the orifice plate.

Turning now to FIG. 4, there is illustrated a preferred embodiment of an orifice plate 18 having a rear side surface 26 with orifice plate projections 28 extending outwardly therefrom. The orifice plate projections 28, as illustrated, may be mesa-like in appearance having inwardly tapered, oppositely disposed outer side edge portions 28*a*. The orifice plate projections 28 are configured to be closely received by the ink receiving cavities 14 or by alignment cavities formed in the front end surface 16 of the body portion 12 (see FIG. 2). If so desired, the orifice plate projections 28 may be other configurations provided that they are configured to be closely received by the corresponding cavities 14 or 32 in the printhead body portion 12. The orifice plate projections 28 are preferably formed from the rear side surface 26 by a laser ablation process. The purpose of the orifice plate projections 28 is two-fold. First, the projections serve to align the discharge orifices 22 (see FIG. 2) of the orifice plate 18 with the ink receiving cavities 14 or alignment cavities 32 of the body portion 12 (see FIG. 2). Second, the orifice plate projections 28 prevent adhesive from entering the ink receiving cavities 14 and the ink discharge orifices 22 when the orifice plate 18 is adhesively secured to the body portion 12. Additionally, as previously stated, the orifice plate projections 28 may be precisely configured to act as a gasket and prevent ink from leaking between the respective ink receiving cavities 14 and the printhead assembly 10 in general.

The mesa-like projections may be formed by placing a laser mask 38 over the energy output end of an excimer laser 40. The laser mask 38 is comprised of a transparent portion 38*a* and opaque portions 38*b*. Opaque portions 38*b* are configured to image the desired shape of the orifice plate projections 28 onto the rear side surface 26 of the orifice plate 18. As the laser light passes through the mask, the transparent portion allows the laser energy to pass therethrough and ablate that portion of the plate directly exposed to the transparent portion 38*a* of the laser mask 38, while the opaque portions 38*b* prevent the laser energy from passing through to the plate. As a result, the orifice plate projections 28 with inwardly tapered outer side edge portions 28*a* are formed in relief in the rear side surface 26. While the laser ablation process has been specifically discussed, it should be understood that other conventional methods for etching orifice plates may be used to form the orifice plate projections 28 if so desired. It should also be understood that the laser mask 38 can be configured to produce the projections on other portions of either the rear side surface 26 of the orifice plate 18 or the front end surface 16 of the body portion 12 in accordance with other embodiments previously discussed.

Figure 5:
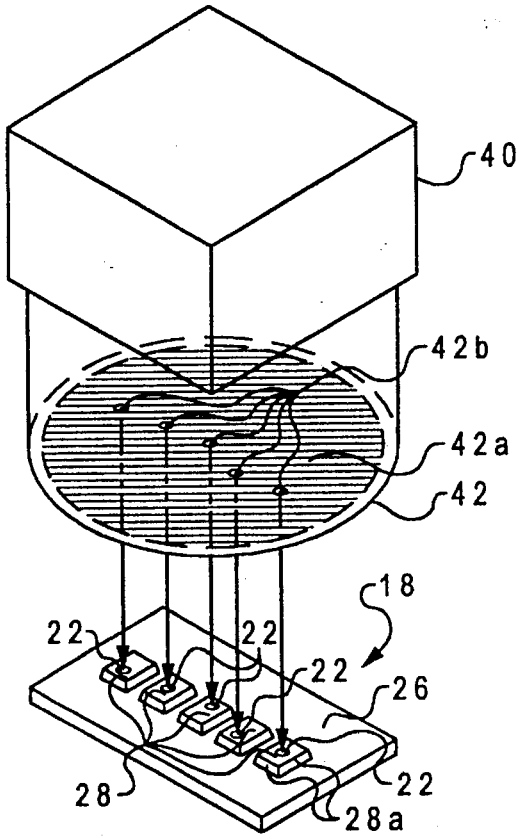
FIG. 5 illustrates an overhead perspective view of an excimer laser with a ink discharge orifice mask positioned thereon and an orifice plate having mesa-like projections extending outwardly from the rear side surface of the orifice plate with ink discharge orifices extending therethrough to the front side surface of the orifice plate.

Referring now to FIG. 5, once the orifice plate projections are formed, an ink discharge orifice laser mask 42 is placed on the energy output end of the excimer laser 40 to form the ink discharge orifices 22 through the orifice plate projections 28. The ink discharge orifice laser mask 42 has an opaque portion 42*a* that blocks the laser energy from passing therethrough and a transparent portion 42*b* configured in a pattern to form the desired ink discharge orifice array when the laser energy passes through the ink discharge orifice laser mask 42. In those embodiments where the projections are configured to align with the ink receiving cavities 14 of the body portion 12, the ink discharge orifice mask 42 will be positioned to form the orifice array through the orifice plate projections 28 to the front side surface 24 of the orifice plate 18.

Figure 6:
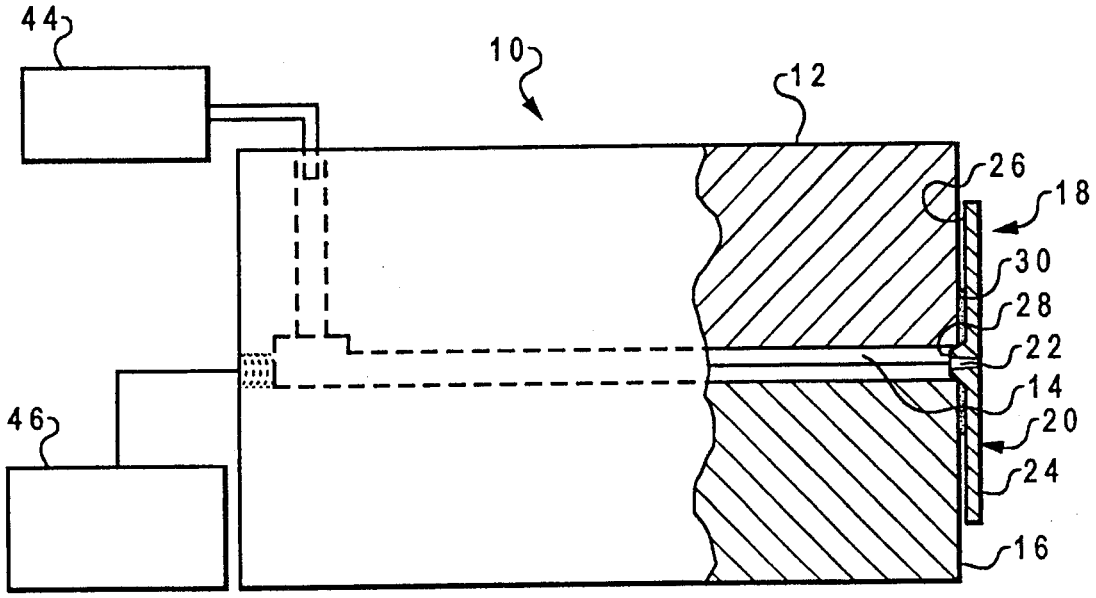
FIG. 6 illustrates a side cross-sectional view of a printhead assembly with the orifice plate adhesively attached to the front end surface portion of the body portion and with the projections precisely aligning the ink discharge orifices with the ink receiving cavity of the body portion.

Turning now to FIG. 6, there is illustrated an assembled printhead 10 having an ink reservoir 44 and a controller 46 connected thereto. The body portion 12 and the ink receiving cavities 14 may be formed using conventional processes. The adhesive layer 30 may be applied to the front end surface 16 using a pad-printing technique. However other methods such as using a roller or screen printing methods may also be used. If any of the adhesive enters the ink receiving cavities 14 of the body portion 12, it may be cleared by flowing pressurized air through the cavities. The projections 28 and ink discharge orifices 22 are formed as previously described. Next, the uniquely configured orifice plate 18 is placed onto the printhead and pressed into position. Because the orifice plate projections of the orifice plate 18 extend into the end of the ink receiving cavity 14, precise alignment of ink discharge orifices 22 to the ink receiving cavity 14 is achieved. In those embodiments where the projections are formed either on the outer corners of the orifice plate 18 or on the outer corners of the front end surface 16 of the body portion 12, the respective alignment cavities and projections are positioned and configured to also achieve a precise alignment of the ink discharge orifices 22 with the ink receiving cavity 14.

Additionally, the extension of the orifice plate projections 28 into the ink receiving cavity 14 prevents the liquid ultra-violet light cured adhesive layer 30 from being squeezed into the ink receiving cavity 14 during assembly. Once in position, the printhead assembly 10 is exposed to an ultra-violet light source at an energy and time duration (approximately 30 seconds in most cases) to cure the adhesive. The printhead assembly is then removed from the assembly line.

Although the present invention and its advantages have been described in detail, it should be understood that various changes, substitutions and alterations can be made herein without departing from the spirit and scope of the invention as defined by the appended claims.

What is claimed is:

1. A printhead assembly for use in an ink jet printer, comprising:

a body portion formed from a piezoelectric material and having a front end surface and a spaced apart interior series of ink receiving cavities opening outwardly through said front end surface;

an orifice plate having discharge orifices formed therethrough, a rear side surface disposed in an opposing, closely adjacent relationship with said front end surface of said body portion and a front side surface; and at least one alignment cavity formed in one of said front end surface of said body portion and said rear side surface of said orifice plate, and at least one alignment projection extending outwardly from the other of said front end surface of said body portion and said rear side surface of said orifice plate, said alignment projection configured to be closely received by said alignment cavity to align said ink discharge orifices with said interior ink receiving cavities of said body portion.

2. The printhead assembly of claim 1 wherein said at least one alignment projection extends outwardly from said rear side surface of said orifice plate and said at least one alignment cavity is formed in said front end surface of said body portion.

3. The printhead assembly of claim 2 wherein said at least one of said alignment projection is integrally formed from said rear side surface of said orifice plate.

4. The printhead assembly of claim 2 wherein said at least one alignment cavity is one of said ink receiving cavities in said body portion.

5. The printhead assembly of claim 1 wherein said alignment projection is a mesa-like projection having oppositely disposed outer side edge portions.

6. The printhead assembly of claim 5 wherein said oppositely disposed outer side edge portions of said mesa-like projection are tapered inwardly.

7. The printhead assembly of claim 1 wherein said at least one alignment projection extends outwardly from said front end surface of said body portion and said at least one alignment cavity is formed in said rear side surface of said orifice plate.

8. The printhead assembly of claim 7 wherein said at least one alignment projection is integrally formed from said front end surface of said body portion.

9. The printhead assembly of claim 1 wherein said orifice plate is formed from a polymer material and said body portion is formed from a piezoelectric ceramic material.

10. The printhead assembly of claim 1 further comprising an adhesive material sandwiched between and adhesively intersecuring said rear side surface of said orifice plate and said front end surface of said body portion.

11. The printhead assembly of claim 10 wherein said adhesive material is an ultra-violet light cured adhesive.

* * * * *